United States Patent [19]

Forsthuber et al.

[11] Patent Number: 4,548,170

[45] Date of Patent: Oct. 22, 1985

[54] LONGITUDINAL HOUSING WALL OF AN INTERNAL COMBUSTION ENGINE

[75] Inventors: Peter Forsthuber, Klosterneuburg; Tomas Visek, Steyr; Anton Dolenc, Vienna, all of Austria

[73] Assignee: Steyr-Daimler-Puch Aktiengesellschaft, Vienna, Austria

[21] Appl. No.: 602,324

[22] Filed: Apr. 20, 1984

[30] Foreign Application Priority Data

Apr. 27, 1983 [AT] Austria ..... 1528/83

[51] Int. Cl.[4] ..... F02F 7/00

[52] U.S. Cl. ..... 123/195 A; 123/198 E; 123/195 C; 181/204

[58] Field of Search ..... 123/195 R, 195 A, 195 S, 123/195 H, 198 E, 195 C; 181/198, 204, 205

[56] References Cited

U.S. PATENT DOCUMENTS 3,695,386 10/1972 Thien et al. ..... 181/204
4,313,405 2/1982 Skatsche et al. ..... 123/195 C
4,377,993 3/1983 List ..... 123/195 R

FOREIGN PATENT DOCUMENTS 325897 11/1975 Austria .
1405857 5/1971 Fed. Rep. of Germany .

OTHER PUBLICATIONS

Bschorr et al., German-Language Article entitled "Schwingungsadsorber zur Reduzierung des Maschinenlärms", VDI-Z 121, (1979), No. 6, pp. 253-261.

*Primary Examiner*—Craig R. Feinberg
*Assistant Examiner*—David A. Okonsky
*Attorney, Agent, or Firm*—Karl F. Ross; Herbert Dubno

[57] ABSTRACT

A longitudinal housing wall for an internal combustion engine is formed with an elongate channel defined by two confronting parallel surfaces. A rod extends in said channel over at least two-thirds of the length of said channel and is coupled to said wall so as to be resiliently movable relative to said wall and capable of absorbing energy of flexural vibration at a predetermined frequency from said wall.

16 Claims, 6 Drawing Figures

LONGITUDINAL HOUSING WALL OF AN INTERNAL COMBUSTION ENGINE

FIELD OF THE INVENTION

This invention relates to a longitudinal wall of a crankcase or an outer pan of an internal combustion engine, which wall can be provided with at least two parallel ribs.

BACKGROUND OF THE INVENTION

Vibration is often induced in such crankcase or pan wall, particularly by the crankshaft mechanism, and causes the wall to radiate sound, which is often rather loud.

It is known from Austrian Patent Specification No. 325,897 to reduce the radiation of sound from housings or housing parts of internal combustion engines in that the housings or housing parts are provided with crossing ribs, which protrude from a wall surface and increase the geometrical moment of inertia and the stiffness of the wall and also increase the natural frequencies of vibration. The ribs however contribute greatly to the mass and the natural frequencies cannot be increased unless the ribs are relatively large so that structural problems arise.

From VDI-Zeitschrift No. 121-1979, No. 6, pages 253–261, it is known to provide vibration absorbers in order to reduce the noise emitted by the engine. If such absorbers are to effect an adequate attenuation, they must have dimensions which are so large that they cannot be used in conventional internal combustion engines. Such absorbers have been used only in stationary engines or in order to preclude the generation of a squealing noise by a tramcar.

German Patent Publication No. 1,405,857 discloses resonant vibration absorbers comprising a mass-spring system that is coupled to the component that is to be damped and tuned to a frequency of vibration of said component. Such absorbers attenuate vibration by absorbing vibration energy at a predetermined frequency from the component that is to be damped. Said energy is dissipated in most cases by a damping element that is connected in parallel to the absorber spring. A resonant absorber of this type has the disadvantage that it is effective only in a narrow frequency band so that it can be used only where vibration at a constant frequency is to be expected, e.g., to attenuate noise in transformer housings.

OBJECT OF THE INVENTION

It is an object of the invention to avoid these disadvantages and to provide a longitudinal housing wall which is of the kind described first hereinbefore and is substantially damped by the use of simple, inexpensive means, which occupy only a small space.

SUMMARY OF THE INVENTION

This object is accomplished in accordance with the invention in that a rod is disposed between two ribs or in a groove of the wall and extends over at least two-thirds of the length of the ribs or of the groove and is either under initial stress and in direct contact with or coupled to the wall or is embedded in a viscoplastic material or in a plastic material having a high mechanical loss factor and is adapted to act as a resonant absorber for absorbing flexural vibration of said longitudinal wall.

It is known that the sound radiation from a platelike member, which is constituted by such longitudinal wall, is mainly due to flexural vibration. A large part of the radiated sound is due in most cases to the first or second mode of flexural vibration of the plate. To ensure an attenuation particularly at the corresponding frequencies, the rod provided in accordance with the invention is tuned to the wall that is to be damped. That tuning is effected by the selection of the material, mass and natural frequency of the rod. The vibrational energy is dissipated as a result of the relative motion taking place between the rod and the ribs or between the rod and the sides of the groove. If the rod is embedded in a viscoplastic material or in a plastic material, this material greatly contributes to the dissipation. The rod is so tuned to the predominating mode of flexural vibration of the longitudinal wall that the rod is capable of acting as a resonant absorber for flexural vibration at the corresponding frequency. Because it is not possible in most cases to design the rod as a resonant absorber for a vibration of the longitudinal wall in a different mode or at a different frequency, an absorption in a broad band can be achieved by the relative motion which arises.

The viscoplastic material or plastic material can be bonded to the ribs or to the groove sides by adhesive or vulcanized joints, which ensure that the rods will be properly tuned even if the longitudinal walls are mass-produced.

To reduce the natural frequency of the rod and to tune it to a low frequency of the longitudinal wall, the rod may be rigidly connected to the longitudinal wall at least at two points. The frequency can be even more exactly matched if additional weights are carried by and secured to the rod.

The rod may be biased by the provision of at least one spring, which is held under initial stress between the rod and each rib or between the rod and each side of the groove and which exerts approximately normal forces on the confronting surfaces of the rod and of the ribs or of the groove. In a simple alternative design the rod is prestressed and resiliently flexible in a direction that is transverse to its longitudinal direction and parallel to the wall.

BRIEF DESCRIPTION OF THE DRAWING

The invention is illustrated by way of example in the accompanying drawing, in which.

SPECIFIC DESCRIPTION

Figure 1:
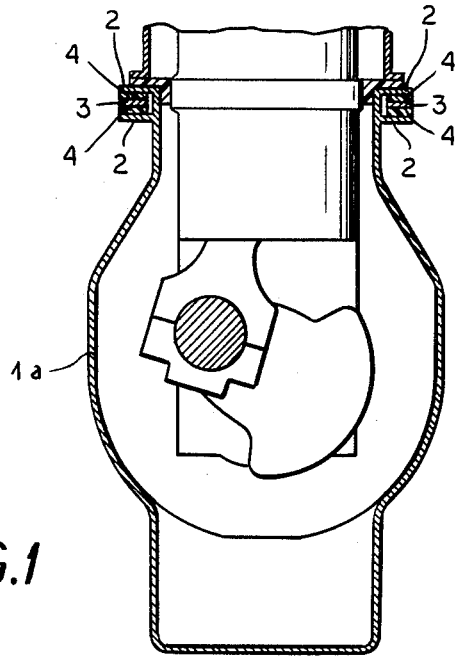
FIG. 1 is a vertical sectional view on a plane that is transverse to the crankshaft and shows the lower part of an internal combustion engine comprising an engine block surrounded by an outer pan.
Figure 2:
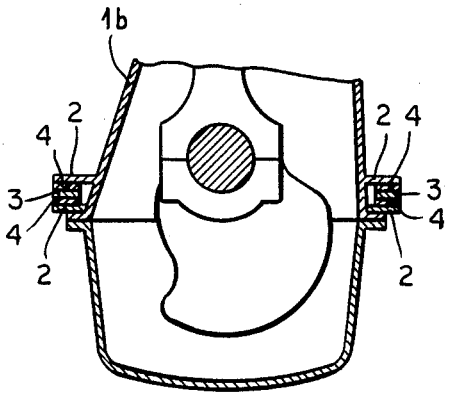
FIG. 2 is a similar view showing the lower part of an internal combustion engine of more conventional type.
Figure 3:
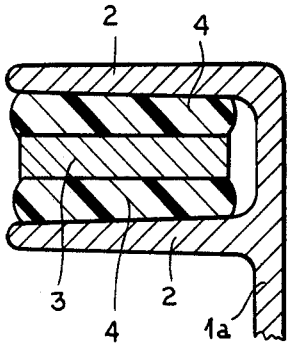
FIG. 3 is an enlarged transverse sectional view showing a housing wall portion provided with ribs.

As can be seen from FIG. 1 the engine block of an internal combustion engine is surrounded by an outer pan, which has a longitudinal wall 1*a*. In accordance with FIG. 2 an internal combustion engine comprises a crankcase having a longitudinal wall 1*b*. Each of the longitudinal walls 1*a* and 1*b* comprises two parallel ribs 2, which extend in the longitudinal direction of the wall and have spaced parallel confronting surfaces defining an elongate channel. An absorption of vibration is ensured in that a rod 3 is disposed between the ribs 2 and is capable of acting as a resonant absorber for flexural vibration of the longitudinal wall 1*a* of the pan or of the longitudinal wall 1*b* of the crankcase. The rod 3 extends over at least two-thirds of the length of the channel defined by the ribs 2 and is so embedded in a plastic material 4 having a high mechanical loss factor that the plastic material 4 is under initial stress. The plastic material 4 is bonded to the ribs 2 by an adhesive or vulcanized joint.

Figure 4:
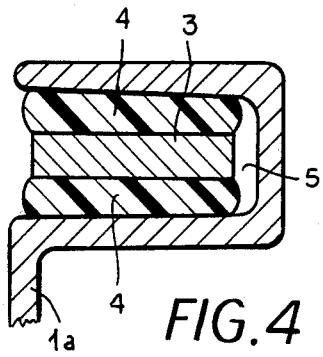
FIG. 4 is a transverse sectional view showing a modified wall formed with a groove.
Figure 5:
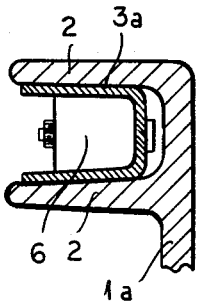
FIG. 5 is a side elevation showing a wall portion provided with a different rod.

As is apparent from FIG. 4, the rod 3 that is embedded in plastic material may be provided between the confronting side faces of an elongate channel, which consists of a groove 5, which is formed in the longitudinal wall 1*a* of the pan. In accordance wth FIG. 5 the rod 3*a* is channel-shaped and inherently resiliently flexible and is held under initial stress in direct contact with the confronting surfaces of the ribs 2 so that the rod 3*a* is resiliently flexible in a direction that is transverse to the longitudinal direction of the rod and parallel to the longitudinal wall. Additional weights 6 may be carried by and secured to the rod 3*a*.

Figure 6:
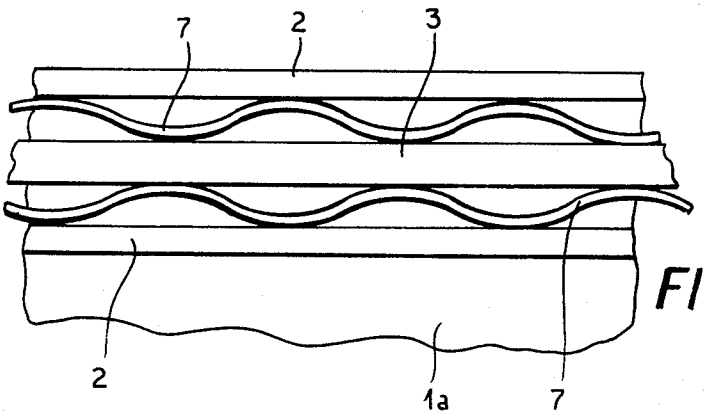
FIG. 6 is a side elevation showing another embodiment.

The embedding plastic material 4 may be replaced by springs 7, which are disposed between the rod 3 and respective ribs 2 (FIG. 6) and which bias the rod 3 by exerting approximately normal forces on the confronting surfaces of the rod 3 and ribs 2.

What is claimed is:

1. In a longitudinal housing wall for an internal combustion engine, which wall is formed with an elongated channel defined by two confronting parallel surfaces, the improvement wherein said channel opens outwardly, is parallel to the longitudinal dimension of said wall and is rectilinear; and a rectilinear rod lying in and extending in said channel over at least two-thirds of the length of said channel parallel thereto and to said surfaces and is coupled to said wall so as to be resiliently movable relative to said wall and capable of absorbing energy of flexural vibration at a predetermined frequency from said wall.

2. The improvement set forth in claim 1, as applied to a longitudinal wall of a crankcase for an internal combustion engine.

3. The improvement set forth in claim 1, as applied to a longitudinal wall of an outer pan for an internal combustion engine.

4. The improvement set forth in claim 1 as applied to a longitudinal wall in which said two confronting parallel surfaces are formed by respective parallel ribs protruding from said wall.

5. The improvement set forth in claim 1, wherein said two confronting parallel surfaces consist of side faces of a groove formed in said wall.

6. The improvement set forth in claim 1, wherein said rod is rigidly connected to said longitudinal wall at least at two points.

7. The improvement set forth in claim 1, wherein said rod is inherently flexibly resilient and held under initial stress in direct contact with said two confronting parallel surfaces so as to be resiliently flexible in a direction which is parallel to said wall and transverse to the longitudinal direction of said rod.

8. The improvement set forth in claim 1, wherein weights are carried by and secured to said rod.

9. The improvement set forth in claim 1, wherein said rod is coupled to said longitudinal wall by resilient means biasing said rod.

10. The improvement set forth in claim 9, wherein said resilient means comprise prestressed springs, which are disposed between said rod and said confronting parallel surfaces and exert approximately normal forces on said rod and said surfaces.

11. The improvement set forth in claim 1, wherein said rod is coupled to said wall by means of bodies of viscoelastic material disposed between opposite sides of said rod and respective ones of said confronting parallel surfaces.

12. The improvement set forth in clam 11, wherein said bodies of viscoelastic material are bonded to said confronting parallel surfaces by adhesive joints.

13. The improvement set forth in claim 11, wherein said bodies of viscoelastic material are bonded to said confronting parallel surfaces by vulcanized joints.

14. The improvement set forth in claim 1, wherein said rod is coupled to said wall by means of bodies of plastic material disposed between opposite sides of said rod and respective ones of said confronting parallel surfaces.

15. The improvement set forth in claim 14, wherein said bodies of plastic material are bonded to said confronting parallel surfaces by adhesive joints.

16. The improvement set forth in claim 14, wherein said bodies of plastic material are bonded to said confronting parallel surfaces by vulcanized joints.

* * * * *